US008210900B2

(12) United States Patent
Tu et al.

(10) Patent No.: US 8,210,900 B2
(45) Date of Patent: Jul. 3, 2012

(54) DISHING AND DEFECT CONTROL OF CHEMICAL MECHANICAL POLISHING USING REAL-TIME ADJUSTABLE ADDITIVE DELIVERY

(75) Inventors: Wen-Chiang Tu, Mountain View, CA (US); You Wang, Cupertino, CA (US); Yuchun Wang, Santa Clara, CA (US); Lakshmanan Karuppiah, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 746 days.

(21) Appl. No.: 12/263,237

(22) Filed: Oct. 31, 2008

(65) Prior Publication Data

US 2010/0112903 A1 May 6, 2010

(51) Int. Cl.
*B24B 49/00* (2006.01)

(52) U.S. Cl. ..... 451/5; 451/41; 451/60

(58) Field of Classification Search ..... 451/41, 451/60, 285–290, 5, 6, 8, 9
See application file for complete search history.

(56) References Cited

U.S. PATENT DOCUMENTS

| | | | | |
|---|---|---|---|---|
| 5,985,045 | A * | 11/1999 | Kobayashi | 451/36 |
| 6,234,877 | B1 * | 5/2001 | Koos et al. | 451/41 |
| 6,589,099 | B2 * | 7/2003 | Haggart et al. | 451/41 |
| 6,677,239 | B2 * | 1/2004 | Hsu et al. | 438/692 |
| 6,796,883 | B1 * | 9/2004 | Molnar | 451/41 |
| 6,863,595 | B1 * | 3/2005 | Zagrebelny | 451/41 |
| 6,939,210 | B2 | 9/2005 | Polyak et al. | |
| 6,946,392 | B2 * | 9/2005 | Sinha | 438/645 |
| 7,086,933 | B2 * | 8/2006 | Vereen et al. | 451/36 |
| 7,112,960 | B2 | 9/2006 | Miller et al. | |
| 7,601,643 | B1 * | 10/2009 | May | 438/692 |
| 7,951,715 | B2 * | 5/2011 | Watanabe et al. | 438/692 |
| 2003/0027505 | A1 * | 2/2003 | Withers et al. | 451/60 |
| 2005/0026439 | A1 * | 2/2005 | Watanabe et al. | 438/691 |
| 2005/0258139 | A1 * | 11/2005 | Nojo et al. | 451/41 |
| 2007/0042675 | A1 | 2/2007 | Benvegnu et al. | |
| 2007/0077671 | A1 | 4/2007 | David et al. | |
| 2007/0131562 | A1 | 6/2007 | Wang et al. | |
| 2007/0224915 | A1 | 9/2007 | David et al. | |
| 2007/0251922 | A1 | 11/2007 | Swedek et al. | |
| 2008/0009227 | A1 | 1/2008 | Benvegnu et al. | |
| 2008/0099443 | A1 | 5/2008 | Benvegnu et al. | |
| 2008/0102734 | A1 | 5/2008 | Benvegnu et al. | |

* cited by examiner

*Primary Examiner* — Maurina Rachuba
(74) *Attorney, Agent, or Firm* — Patterson & Sheridan, LLP

(57) ABSTRACT

A method and apparatus for polishing or planarizing a substrate by a chemical mechanical polishing process. In one embodiment a method of processing a semiconductor substrate is provided. The method comprises positioning a substrate on a polishing apparatus comprising a polishing pad assembly, delivering a polishing slurry to a surface of the polishing pad assembly, polishing the substrate with the surface of the polishing pad assembly, monitoring the removal rate of material from a plurality of regions on the surface of the substrate, determining whether the plurality of regions on the surface of the substrate are polishing uniformly, and selectively delivering a polishing slurry additive to at least one region of the plurality of regions to obtain a uniform removal rate of material from the plurality of regions on the surface of the substrate, wherein the removal rate of material from the at least one region is different than at least one other region of the plurality of regions.

14 Claims, 5 Drawing Sheets

DISHING AND DEFECT CONTROL OF CHEMICAL MECHANICAL POLISHING USING REAL-TIME ADJUSTABLE ADDITIVE DELIVERY

BACKGROUND OF THE INVENTION

1. Field of the Invention

Embodiments described herein relate to removing material from a substrate. More particularly, the embodiments described herein relate to polishing or planarizing a substrate by a chemical mechanical polishing process.

2. Description of the Related Art

Sub-quarter micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

Multilevel interconnects are formed using sequential material deposition and material removal techniques on a substrate surface to form features therein. As layers of materials are sequentially deposited and removed, the uppermost surface of the substrate may become non-planar across its surface and require planarization prior to further processing. Planarization or "polishing" is a process in which material is removed from the surface of the substrate to form a generally even, planar surface. Planarization is useful in removing excess deposited material, removing undesired surface topography, and surface defects, such as surface roughness, agglomerated materials, crystal lattice damage, scratches, and contaminated layers or materials to provide an even surface for subsequent photolithography and other semiconductor manufacturing processes.

Chemical Mechanical Planarization, or Chemical Mechanical Polishing (CMP), is a common technique used to planarize substrates. CMP utilizes a chemical composition, such as slurries or other fluid medium, for selective removal of materials from substrates. In conventional CMP techniques, a substrate carrier or polishing head is mounted on a carrier assembly and positioned in contact with a polishing pad in a CMP apparatus. The carrier assembly provides a controllable pressure to the substrate, thereby pressing the substrate against the polishing pad. The pad is moved relative to the substrate by an external driving force. The CMP apparatus affects polishing or rubbing movements between the surface of the substrate and the polishing pad while dispersing a polishing composition to affect chemical activities and/or mechanical activities and consequential removal of materials from the surface of the substrate.

One objective of CMP is to remove a predictable amount of material while achieving uniform surface topography both within each substrate and from substrate to substrate when performing a batch polishing process.

Dishing occurs when a portion of the surface of the inlaid metal of the interconnection formed in the feature definitions in the interlayer dielectric is excessively polished, resulting in one or more concave depressions, which may be referred to as concavities or recesses. Dishing is more likely to occur in wider or less dense features on a substrate surface.

Therefore, there is a need for a polishing process which accurately and reliably removes a predictable amount of material while achieving uniform surface topography with reduced dishing.

SUMMARY OF THE INVENTION

Embodiments described herein relate to removing material from a substrate. More particularly, the embodiments described herein relate to polishing or planarizing a substrate by a chemical mechanical polishing process. In one embodiment a method of processing a semiconductor substrate is provided. The method comprises positioning a substrate on a polishing apparatus comprising a polishing pad assembly, delivering a polishing slurry to a surface of the polishing pad assembly, polishing the substrate with the surface of the polishing pad assembly, monitoring the removal rate of material from a plurality of regions on the surface of the substrate, determining whether the plurality of regions on the surface of the substrate are polishing uniformly, and selectively delivering a polishing slurry additive to at least one region of the plurality of regions to obtain a uniform removal rate of material from the plurality of regions on the surface of the substrate, wherein the removal rate of material from the at least one region is different than at least one other region of the plurality of regions.

In another embodiment a method of processing a semiconductor substrate is provided. The method comprises positioning a substrate on a polishing apparatus comprising a polishing pad assembly and a polishing fluid dispense arm assembly comprising an adjustable additive delivery nozzle, determining an incoming thickness profile of conductive material across a surface of the substrate, polishing the substrate with a surface of the polishing pad assembly, developing a real-time thickness profile model of the conductive material across the surface of the substrate, and positioning the adjustable additive delivery nozzle, and selectively delivering a polishing slurry additive to the surface of the substrate to obtain a uniform removal rate of material from the plurality of regions on the surface of the substrate.

In yet another embodiment a system for chemical mechanical polishing of a substrate is provided. The system comprises a platen assembly, a polishing surface supported on the platen assembly, one or more polishing heads on which substrates are retained while polishing, and a polishing fluid dispense arm assembly comprising a dispense arm and an adjustable additive delivery nozzle positionable longitudinally along the polishing fluid dispense arm assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiment without specific recitation.

DETAILED DESCRIPTION

Embodiments described herein relate to removing material from a substrate. More particularly, the embodiments described herein relate to polishing or planarizing a substrate by a chemical mechanical polishing process. Moving forward to 32 nm node and beyond, the performance of CMP processes, such as defect, dishing and corrosion, shows an increased dependence on the chemical composition of polishing slurry, particularly during the initial and final stages of a polishing process. The concentration of certain additives plays a very important role in controlling defect, dishing, and corrosion. However, in practice, such additives are not adjustable during the polishing process and the concentration of such additives varies from the wafer center to wafer edge locations as such additives are not consumed uniformly. In addition, for certain applications inhibitors provided at low concentrations are needed during either the initial stages or final stages of the polishing process. Embodiments described herein provide an apparatus and method for introducing specific polishing slurry additives during various stages of a CMP process to control defect, dishing development, and/or corrosion throughout the CMP process.

Embodiments described herein provide an apparatus which has an adjustable additive delivery position that may be adjusted in real-time during a CMP process. In one embodiment, the apparatus may be integrated into a slurry delivery arm. In one embodiment, the apparatus has an adjustable delivery point capable of selectively distributing polishing additives to either the wafer center or wafer edge as desired. In one embodiment, selective distribution of polishing additives may occur during specific stages of the polishing process. For example, a rate promoter may be used during the initial stages of the CMP process, while defect, dishing and corrosion reducing additives may be used during the final stages of the polishing process. In one embodiment, selective distribution of polishing additives may occur in response to monitoring of the wafer polishing profile. Advantageously, the embodiments described herein provide increased polishing slurry composition flexibility and process tuning capability for chemical mechanical polishing processes.

While the particular apparatus in which the embodiments described herein can be practiced is not limited, it is particularly beneficial to practice the embodiments in a REFLEXION® CMP system, REFLEXION® LK CMP system, and a MIRRA MESA® system sold by Applied Materials, Inc., Santa Clara, Calif. Additionally, CMP systems available from other manufacturers may also benefit from embodiments described herein. Embodiments described herein may also be practiced on overhead circular track polishing systems.

Figure 1:
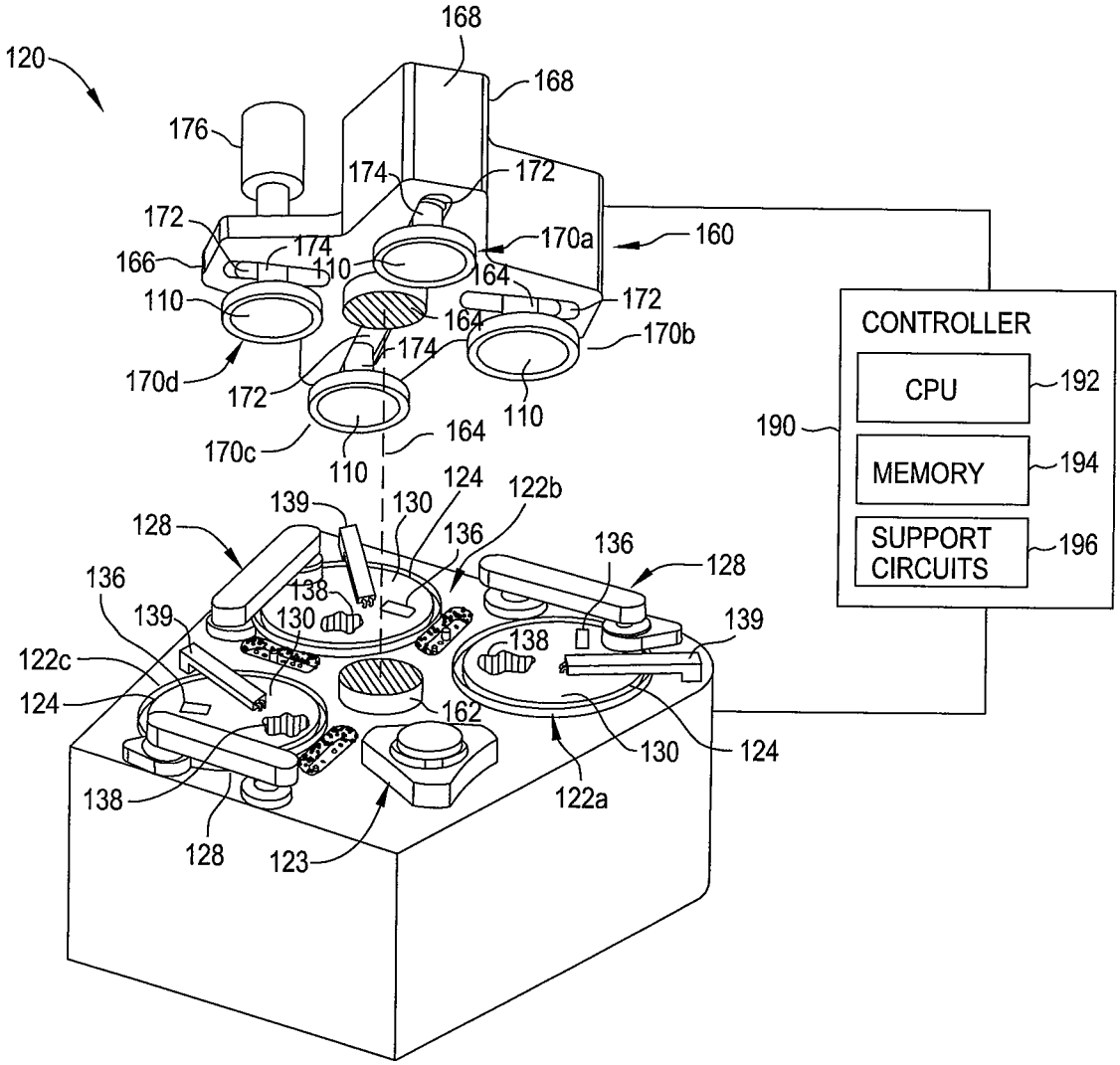
FIG. 1 is a schematic cross-sectional view of a chemical mechanical polishing apparatus.

FIG. 1 shows a chemical mechanical polishing apparatus 120 that can polish one or more substrates 110 such as wafers. The polishing apparatus 120 includes a series of polishing stations 122*a-c* and a transfer station 123. The transfer station 123 transfers the substrates 110 between the carrier heads 170*a-d* and a loading apparatus (not shown).

Each polishing station 122 includes a rotatable platen assembly 124 on which is placed a polishing pad assembly 130. The first and second stations 122*a*, 122*b* can include a two-layer polishing pad with a hard durable outer surface or a fixed-abrasive pad with embedded abrasive particles. The final polishing station 122*c* can include a relatively soft pad. Each polishing station 122 can also include a pad conditioner apparatus 128 to maintain the condition of the polishing pad assembly 130 so that it will effectively polish substrates.

A rotatable multi-head carousel 160 supports four carrier heads 170. The carousel 160 is rotated by a central post 162 about a carousel axis 164 by a carousel motor assembly (not shown) to orbit the carrier heads 170 and the substrates 110 attached thereto between the polishing stations 122 and the transfer station 123. Three of the carrier heads 170 receive and hold substrates 110, and polish the substrates 110 by pressing them against the polishing pads 130. Meanwhile, one of the carrier heads 170 receives a substrate 110 from and delivers a substrate 110 to the transfer station 123.

Each carrier head 170 is connected by a carrier drive shaft 174 to a carrier head rotation motor 176 (shown by the removal of one quarter of cover 168) so that each carrier head 170 can independently rotate about it own axis. In addition, each carrier head 170 independently laterally oscillates in a radial slot 172 formed in carousel support plate 166. A description of a suitable carrier head 170 can be found in U.S. Pat. No. 6,422,927, entitled CARRIER HEAD WITH CONTROLLABLE PRESSURE AND LOADING AREA FOR CHEMICAL MECHANICAL POLISHING.

A slurry 138 comprising an oxidizer, a passivation agent such as a corrosion inhibitor, a pH buffer, a metal complexing agent, and combinations thereof can be supplied to the surface of the polishing pad assembly 130 by a polishing fluid dispense arm assembly 139. If the polishing pad assembly 130 is a standard pad, the slurry 138 can also include abrasive particles (e.g., silicon dioxide for oxide polishing). A clear window 136 is included in the polishing pad assembly 130 and is positioned such that it passes beneath substrate 110 during a portion of the platen's rotation, regardless of the translational position of the carrier head 170. The clear window 136 may be used for metrology devices, for example, an eddy current sensor may be placed below the clear window 136. In certain embodiments, the window 236 and related sensing methods may be used for an endpoint detection process.

To facilitate control of the polishing apparatus 120 and processes performed thereon, a controller 190 comprising a central processing unit (CPU) 192, a memory 194, and support circuits 196, is connected to the polishing apparatus 120. The CPU 192 may be one of any form of computer processor that can be used in an industrial setting for controlling various drives and pressures. The memory 194 is connected to the CPU 192. The memory 194, or computer-readable medium, may be one or more of readily available memory such as random access memory (RAM), read only memory (ROM), floppy disk, hard disk, or any other form of digital storage, local or remote. The support circuits 196 are connected to the CPU 192 for supporting the processor in a conventional manner. These circuits include cache, power supplies, clock circuits, input/output circuitry, subsystems, and the like.

Figure 2:
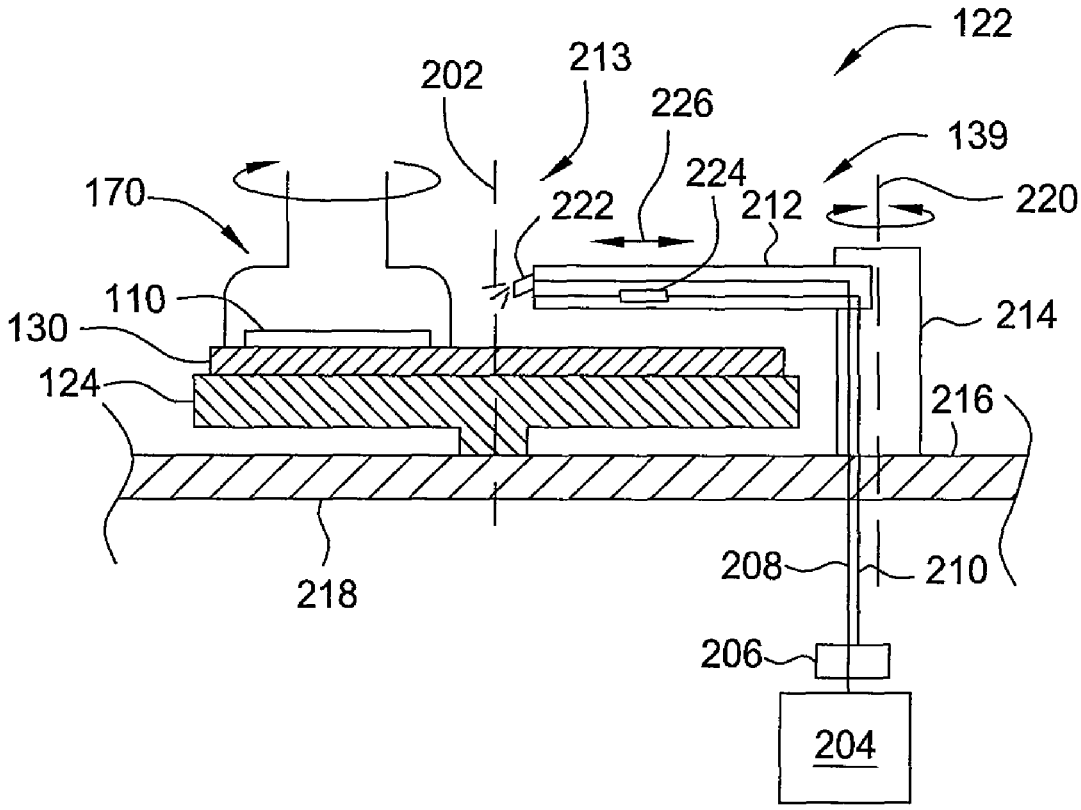
FIG. 2 is a schematic cross-sectional view of a polishing station.

FIG. 2 is a schematic cross-sectional view of the chemical mechanical polishing station 122 operable to polish the substrate 110. The polishing station 122 includes the rotatable platen assembly 124, on which the polishing pad assembly 130 is situated. The platen is operable to rotate about an axis 202. For example, a motor (not shown) can turn a drive shaft (not shown) to rotate the platen assembly 124. The polishing pad assembly 130 can be detachably secured to the platen assembly 124, for example, by a layer of adhesive. When worn, the polishing pad assembly 130 can be detached and replaced.

The polishing fluid dispense arm assembly 139 includes a plurality of nozzles 213 disposed on the polishing fluid dispense arm assembly 139, at least one polishing fluid supply 204 and at least one additive supply 206 are coupled with the polishing fluid dispense arm assembly 139. Generally, each polishing station 122 is equipped with a respective polishing dispense arm assembly 139 positioned proximate to the respective platen assembly 124. In the embodiment depicted in FIG. 1, the three polishing stations 122 each have a polishing fluid dispense arm assembly 139 associated therewith. Each polishing fluid dispense arm assembly 139 may be coupled to the dedicated polishing fluid supply 204 and the additive supply 206, or may be configured to receive polishing fluid from a single or multiple shared polishing fluid supplies. Each polishing fluid dispense arm assembly 139 includes a first fluid delivery tube 208 coupled with the polishing fluid supply 204 and a second fluid delivery tube 210 coupled with the additive supply 206.

The controller 190 interfaces with the polishing fluid supply 204 and the additive supply 206 so that the ratio between the fluid supplied from the first fluid delivery tube 208 and the second fluid delivery tube 210 may be maintained at a predetermined value, or changed to yield a desired polishing result. In one embodiment, the polishing fluid supply 204 may provide a polishing fluid and the additive supply 206 may provide an additive such as a rate promoter or corrosion inhibitor to the polishing pad assembly 130.

With reference to FIG. 2, the polishing fluid dispense arm assembly 139 includes a dispense arm 212 affixed to and extending laterally from a support member 214 above a top surface 216 of a base 218. The support member 214 is rotatably mounted about an axis 220 to the base 218 to allow the dispense arm 212 to be rotated between a standby or purge position clear of the platen assembly 124 and a dispense position over the surface of the polishing pad assembly 130.

For simplicity in the embodiment depicted in FIG. 2, the first fluid delivery tube 208 and the second fluid delivery tube 210 are shown routed along the fluid dispense arm assembly 139 for supplying polishing fluid and additives to the surface of the polishing pad assembly 130 disposed on the platen assembly 124. However, any number of delivery tubes and any number of fluid sources may be utilized to supply polishing fluid and additives from a common dispense arm 212 to a single platen assembly 124. Each delivery tube is comprised of a resilient and flexible material, such as silicone. The interior of the tube must be substantially free of interior anomalies.

The plurality of nozzles 213 may be disposed along the portion of the dispense arm 212 which is disposed over the polishing pad assembly 130. In one embodiment, the plurality of nozzles 213 may comprise a slurry delivery nozzle 222 and an adjustable additive delivery nozzle 224. The slurry delivery nozzle 222 may be coupled with the polishing fluid supply 206 and may be positioned at the distal end of the dispense arm 212. The adjustable additive delivery nozzle 224 may be coupled with the additive supply 206 and is positionable longitudinally as shown by arrow 226 along the dispense arm 212.

Figure 3:
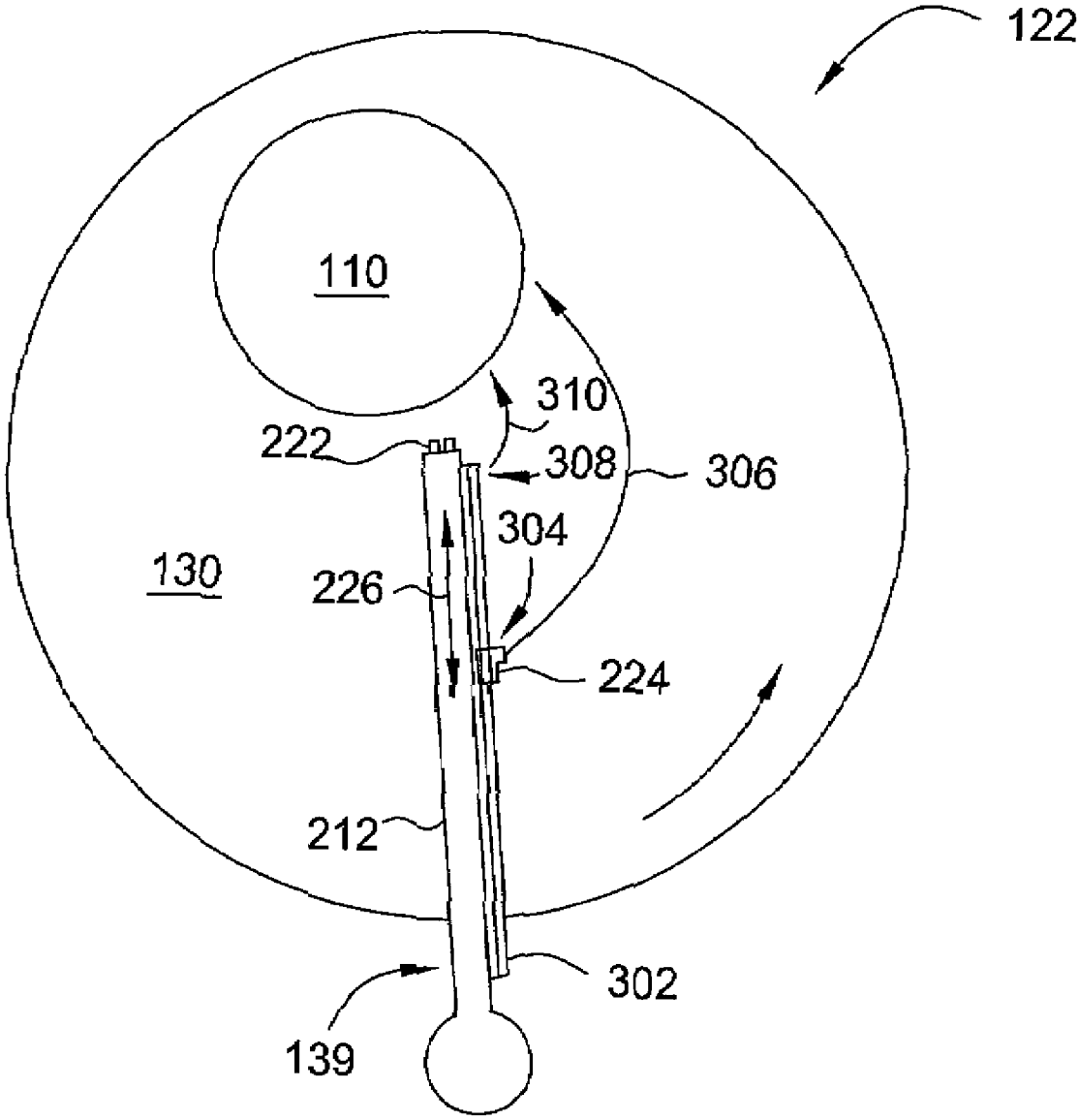
FIG. 3 is a schematic top view of the polishing station of FIG. 2.

With reference to FIG. 3, in one embodiment, the dispense arm 212 includes a track 302 along which the adjustable additive delivery nozzle 224 may be selectively positioned to deliver additives to the surface of the polishing pad assembly 130. In one embodiment, the polishing fluid dispense arm assembly 139 further includes an actuator (not shown) coupled with the adjustable additive delivery nozzle 224 for controlling the movement of the adjustable additive delivery nozzle 224 along the track 302. The actuator in response to instructions from the controller 190 may move the adjustable additive delivery nozzle 224 longitudinally along the track 302. The actuator may be a gear motor, a harmonic drive, a linear actuator, a motorized lead screw, a hydraulic cylinder, a pneumatic cylinder or other device suitable for imparting longitudinal movement of the adjustable additive delivery nozzle 224 along the track 302.

Figure 4:
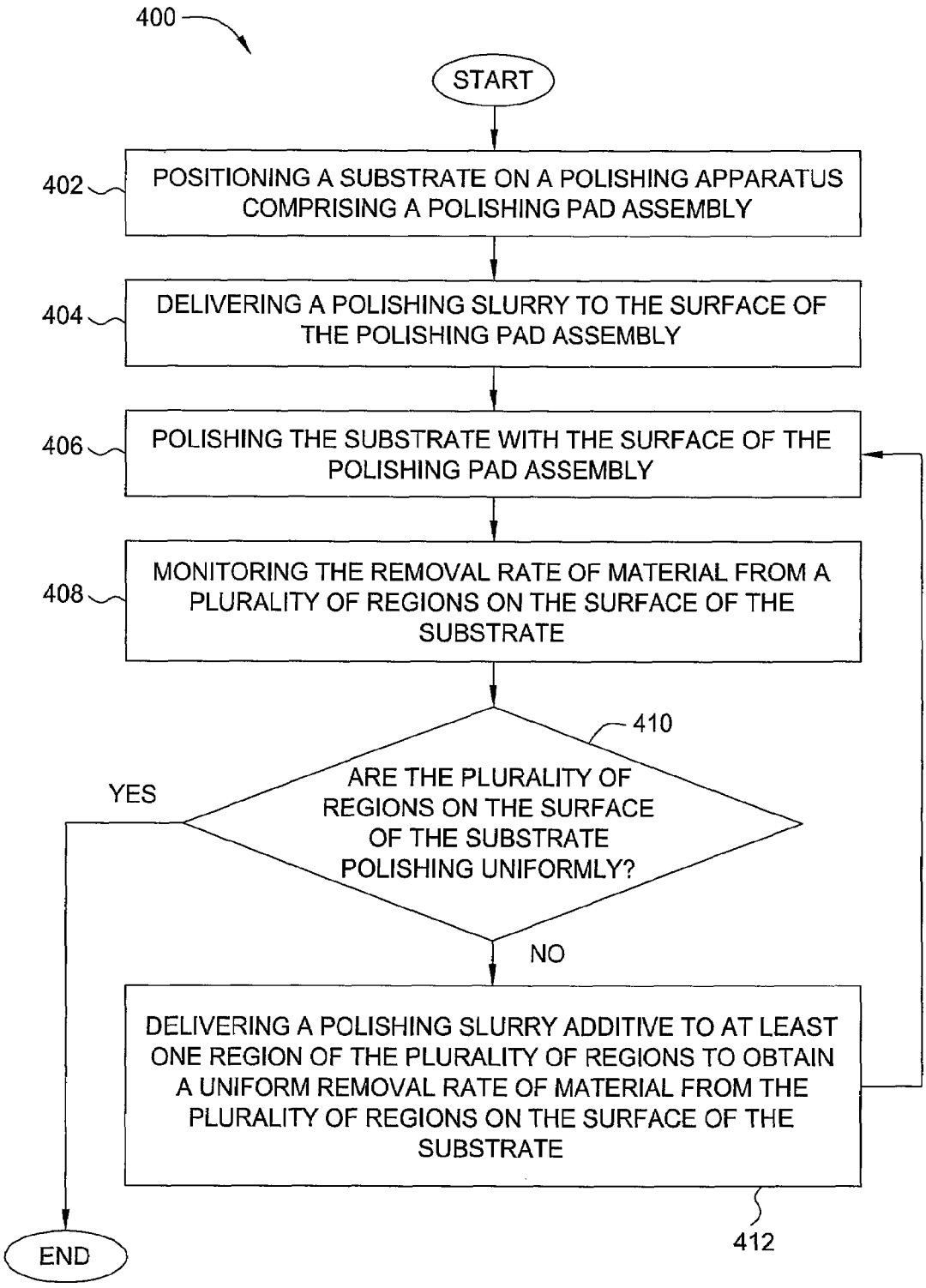
FIG. 4 is a flow chart of one embodiment of a polishing method described herein.

FIG. 4 is a flow chart of one embodiment of a polishing method 400 described herein. In one embodiment, the polishing method 400 enables selective control of additive delivery to the surface of a polishing pad assembly 130 to tailor the removal profile of material from the surface of a substrate 110 during a chemical mechanical polishing process. Advantageously, the embodiments described herein reduce surface dishing and increase polishing uniformity.

In one embodiment a method 400 of processing a semiconductor substrate 110 is provided. The method 400 begins by positioning a substrate 110 on a polishing apparatus 120 comprising a polishing pad assembly 130 (step 402). The substrate 110 may have a material disposed thereon. Exemplary materials include insulating materials, conductive materials, and combinations thereof. In one embodiment, the conductive material may comprise copper containing materials, tungsten containing materials, or any conductive material used in the industry to produce electronic devices. In one embodiment, the insulating materials may comprise materials such as silicon oxide, silicon nitride, and silicon carbide.

In one embodiment, an incoming or pre-polish profile determination is made, for example by measuring the thickness of materials over portions of the substrate. The profile determination may include determining the thickness profile of a conductive material across the surface of the substrate. A metric indicative of thickness may be provided by any device or devices designed to measure film thickness of semiconductor substrates. Exemplary non-contact devices include iSCAN™ and iMAP™ available from Applied Materials, Inc. of Santa Clara, Calif., which scan and map the substrate, respectively. The pre-polish profile determination may be stored in the controller 190.

A polishing slurry 138 is delivered to the surface of the polishing pad assembly 130 (step 404). In one embodiment, the polishing slurry 138 is stored in the polishing fluid supply 206. In one embodiment, the polishing slurry 138 is delivered to the polishing pad assembly 130 via the slurry delivery nozzle 222 positioned at the distal end of the dispense arm 212. In one embodiment, the polishing slurry 138 may be delivered to the polishing pad assembly 130 during the polishing process. In another embodiment, the polishing slurry 138 may be supplied to the polishing pad assembly 130 prior to commencement of and during the polishing process.

In certain embodiments, the polishing slurry 138 may comprise an oxidizer, a passivation agent such as a corrosion inhibitor, a pH buffer, a metal complexing agent, abrasives, and combinations thereof. In one embodiment, the oxidizer may be selected from the group comprising hydrogen peroxide, sodium peroxide, perboric acid, percarbonate, urea peroxide, urea hydrogen peroxide, and combinations thereof. Examples of suitable corrosion inhibitors include compounds having azole groups such as benzotriazole, mercaptobenzotriazole, 5-methyl-1-benzotriazole, and combinations thereof. Other suitable corrosion inhibitors include film forming agents that are cyclic compounds, for example, imidazole, benzimidazole, triazole, and combinations thereof. Examples of suitable pH buffers include bases, organic acids, and inorganic acids. Examples of suitable metal complexing agents include chelating agents such as organic acids and salts thereof. Examples of suitable abrasives particles include inorganic abrasives, polymeric abrasives, and combinations thereof. Examples of suitable inorganic abrasive particles that may be used in the electrolyte include, but are not limited to, silica, alumina, zirconium oxide, titanium oxide, cerium oxide, germanium, or any other abrasives of metal oxides, known or unknown. For example, colloidal silica may be positively activated, such as with an alumina modification or a silica/alumina composite.

The substrate 110 is polished with the surface of the polishing pad assembly 130 (step 406). In this step, the substrate 110 is brought into contact with the polishing pad assembly 130, more particularly, the material, such as conductive material, on the substrate 110 is brought into contact with the upper surface of the polishing pad assembly 130. The polishing pad assembly 130 is rotated relative to the substrate 110, which is also rotated. In one embodiment, the polishing process may comprise a multi-step polishing process. For example, bulk material may be removed on a first platen assembly 124 using a high removal rate process with any residual conductive material removed on a second platen assembly 124 using a "soft landing" or low pressure/low removal rate process followed by a barrier polish process performed on a third platen assembly 124. In one embodiment, the polishing process may be performed on a single platen.

The removal rate of the material from a plurality of regions on the surface of the substrate 110 may be monitored (step 408). In one embodiment, the removal rate of material may be monitored by developing a real-time profile control (RTPC) model of the substrate 110. The thickness of the material may be measured at different regions on the substrate 110. For example, the thickness of a metal layer at different regions on a substrate 110 may be monitored to ensure that processing is proceeding uniformly across the substrate 110. Thickness information for regions of the substrate 110 (which collectively may be referred to as a "profile" of the substrate) may then be used to adjust polishing parameters such as the delivery of a slurry additive in real-time to obtain desired cross-substrate uniformity. For example, in a chemical mechanical polishing process, the thickness of a metal layer at different regions on the substrate 110 may be monitored, and detected non-uniformities may cause the CMP system to adjust polishing parameters in real-time. Such profile control may be referred to as real time profile control (RTPC). In one embodiment, RTPC may be used to control the remaining material layer profile by adjusting zone pressures in the carrier head 170.

It is determined whether the plurality of regions on the surface of the substrate 110 are polishing uniformly (step 410). During the polishing process, a material layer on the substrate 110 may be processed. For example, a conductive layer on a substrate 110 may be polished with the CMP apparatus 120 including the multi-zone carrier head 170. While the substrate 110 is being polished, profile data may be obtained for a region on the substrate 110. For example, eddy current data related to the thickness of a portion of the conductive layer coupled with a magnetic field produced by an eddy current sensing system may be obtained during polishing. The profile data may be processed. For example, signal processing algorithms may be used to equate eddy current measurements with particular regions of the substrate 110. The processed profile data may then be compared to desired profile data to determine if a profile error is greater than a minimum acceptable error. If it is not, the processing parameters may be unchanged, and further profile data may be obtained for a different region on the substrate 110. For example, an eddy current sensor may be translated with respect to the substrate, so that profile information is obtained for regions at different radial distances from the center of the substrate. Note that the process of obtaining and processing data may occur as separate discrete steps for different regions of the substrate, may occur generally continuously and concurrently, with data acquisition occurring on timescales that are short compared to relative translation of an eddy current sensor with respect to a substrate. Moreover, after sorting the eddy current measurements into radial ranges, information on the conductive layer thickness can be fed in real-time into the controller 190 to periodically or continuously modify the polishing pressure profile applied by the carrier head 170. Examples of suitable RTPC techniques and apparatus are further described in U.S. Pat. No. 7,229,340, to Hanawa et al. entitled METHOD AND APPARATUS FOR MONITORING A METAL LAYER DURING CHEMICAL MECHANICAL POLISHING and U.S. patent application Ser. No. 10/633,276, entitled EDDY CURRENT SYSTEM FOR IN-SITU PROFILE MEASUREMENT, filed Jul. 31, 2003, now issued as U.S. Pat. No. 7,112,960.

If the plurality of regions on the surface of the substrate 110 are not polishing uniformly, a polishing slurry additive may be delivered to at least one region of the plurality of regions to obtain a uniform removal rate of material from the plurality of regions on the surface of the substrate (step 412). Delivery of the polishing slurry additive can comprise delivering the polishing slurry additive to a predetermined location on the polishing pad assembly 130 such that the slurry additive is delivered to a specific region of the plurality of regions on the substrate. Delivery of the polishing slurry additive may further comprise modifying the flow rate of the slurry additive such that the slurry additive is delivered to a specific region of the plurality of regions on the substrate at either an increased or decreased flow rate.

Suitable polishing slurry additives include, for example, corrosion inhibitors, polymeric inhibitors, surfactants, rate promoters, abrasives, and combinations thereof.

Suitable corrosion inhibitors include organic compounds having azole groups. Examples of organic compounds having azole groups include benzotriazole, mercaptobenzotriazole, 5-methyl-1-benzotriazole, and combinations thereof. Other suitable corrosion inhibitors include film forming agents that are cyclic compounds, for example, imidazole, benzimidazole, triazole, and combinations thereof. Derivatives of benzotriazole, imidazole, benzimidazole, triazole, with hydroxy, amino, imino, carboxy, mercapto, nitro and alkyl substituted groups may also be used as corrosion inhibitors. Other corrosion inhibitors include urea and thiourea among others.

Suitable polymeric inhibitors include compounds having a nitrogen atom (N), an oxygen atom (O), or a combination of the two. Polymeric inhibitors include ethyleneimine ($C_2H_5N$) based polymeric materials, such as polyethyleneimine (PEI) having a molecular weight between about 400 and about 1,000,000, such as between about 1,000 and about 750,000, of (—$CH_2$—$CH_2$—NH—) monomer units, ethylene glycol ($C_2H_6O_2$) based polymeric materials, such as polyethylene glycol (PEG) having a molecular weight between about 200 and about 100,000 comprising $(OCH_2CH_2)_n$ monomer units, or combinations thereof. Examples of suitable polyethyleneimine compounds include 2,000 and 75,000 molecular weight polyethyleneimine. Polyamine and polyimide polymeric material may also be used as polymeric inhibitors in the composition. Other suitable polymeric inhibitors include oxide polymers, such as, polypropylene oxide and ethylene oxide/propylene oxide co-polymer (EOPO), with a Molecular Weight range between about 200 and about 100,000.

Additionally, the polymeric inhibitors may comprise polymers of heterocyclic compounds containing nitrogen and/or oxygen atoms, such as polymeric materials derived from monomers of pyridine, pyrole, furan, purine, or combinations thereof. The polymeric inhibitors may also include polymers with both linear and heterocyclic structural units containing nitrogen and/or oxygen atoms, such as a heterocyclic structural units and amine or ethyleneimine structural units. The polymeric inhibitors may also include carbon containing functional groups or structural units, such as homocyclic compounds, such as benzyl or phenyl functional groups, and linear hydrocarbons suitable as structural units or as functional groups to the polymeric backbone. A mixture of the polymeric inhibitors described herein is also contemplated, such as a polymeric mixture of a heterocyclic polymer material and an amine or ethyleneimine polymeric material (polyethyleneimine).

Suitable surfactants may include non-ionic surfactants as well as ionic surfactants including anionic surfactants, cationic surfactants, amphoteric surfactants, and ionic surfactants having more than one ionic functional group, such as Zwitter-ionic surfactants. Dispersers or dispersing agents are considered to be surfactants as surfactants are used herein.

Suitable rate promoters accelerate the rate of material removal during a chemical mechanical polishing process. Suitable rate promoters include oxidizers and hydroxides, such as potassium hydroxide.

Suitable oxidizers include persulfate oxidizers and peroxide oxidizers. In one embodiment, the persulfate oxidizer may be selected form the group comprising ammonium persulfate, sodium persulfate, potassium persulfate, and combinations thereof. In one embodiment, the peroxide oxidizer may be selected from the group comprising hydrogen peroxide, sodium peroxide, perboric acid, percarbonate, urea peroxide, urea hydrogen peroxide, and combinations thereof.

In one embodiment, the adjustable additive delivery nozzle 224 may be selectively adjusted in real-time during the polishing process. In one embodiment, the adjustable additive delivery nozzle 224 may be used in conjunction with the RTPC model of the substrate 110. In one embodiment, the adjustable additive delivery nozzle 224 may be positioned to deliver additives to the surface of the polishing pad assembly 130 such that the additives will be distributed to different regions on the surface of the substrate 110. For example, with reference to FIG. 3, if the RTPC model indicates that the removal rate of material from the substrate 110 is higher for the edge region of the substrate 110 relative to the center of the substrate 110, the adjustable additive delivery nozzle 224 would be positioned at a first delivery point 304 to direct the additive slurry flow along a first additive flow path 306 to deliver the additive toward the center region of the substrate 110. In one embodiment, the additive includes a rate promoter to increase the rate of material removal at the center of the substrate 110 relative to the edge region of the substrate 110 providing a more uniform polish to the substrate 110. In another embodiment, where the RTPC model indicates that the removal rate of material from the substrate 110 is higher for the edge region of the substrate 110 relative to the center region of the substrate 110, the adjustable additive delivery nozzle 224 may be positioned at a second delivery point 308 to direct the additive slurry flow along a second additive flow path 310 to deliver the additive toward the center region of the substrate 110. In this embodiment, the additive may include a corrosion inhibitor to decrease the rate of material removal from the center region of the substrate 110 providing a more uniform polish to the substrate 110.

In another embodiment, if the RTPC model indicates that the removal rate of material from the substrate 110 is higher for the center region of the substrate 110 relative to the edge region of the substrate 110, the adjustable additive delivery nozzle 224 would be positioned at a first delivery point 304 to direct the additive, such as a corrosion inhibitor, along a first additive flow path 306 to deliver the additive toward the center region of the substrate 110. In another embodiment, where the RTPC model indicates that the removal rate of material from the substrate 110 is higher for the edge region of the substrate 110 relative to the center region of the substrate 110, the adjustable additive delivery nozzle 224 may be positioned at a second delivery point 308 to direct the additive, such as a rate promoter, along a second additive flow path 310 which would deliver the additive toward the center region of the substrate 110.

Although only a first delivery point 304 and a second delivery point 308 are shown, it should be understood that the adjustable additive delivery nozzle 224 may be positioned at any point along the track 302 in order to deliver the slurry additive to a desired region of the substrate 110. Additional delivery points and additive flow paths may be determined by polishing a set-up substrate or series of set-up substrates with similar profiles using similar polishing conditions. The additional delivery points and additive flow paths may be determined using a series of algorithms which take into account such processing parameters as platen rotation rate, substrate rotation rate, the components of the polishing slurry, the flow rate of the polishing slurry, the flow rate of the additives, the concentration of the additive present on the platen, and combinations thereof. In one embodiment, the preferred additive flow rate is from about 50 ml/min to about 200 ml/min. The delivery points and additive delivery flow paths determined by polishing the set-up substrates may be stored in a library in controller 190. The delivery points and additive delivery flow paths may be selected in real-time based on the polishing profile of the substrate 110.

Figure 5A:
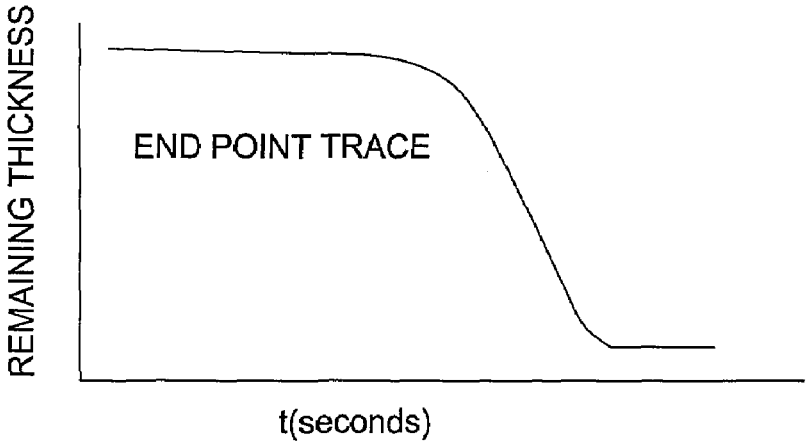
FIGS. 5A-5C are schematic plots for an adjustable additive delivery timing sequence for one embodiment described herein.
Figure 5B:
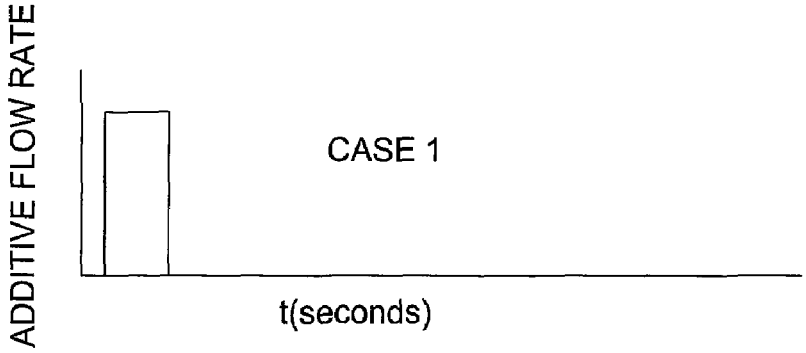
Figure 5C:
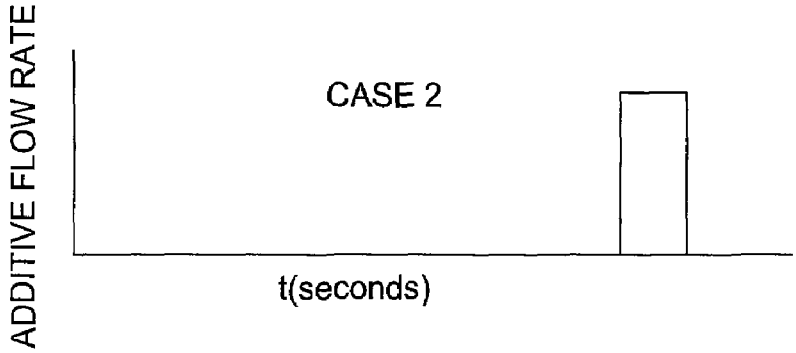

In another embodiment, selective distribution of polishing additives may occur during specific stages of the polishing process. FIGS. 5A-5C are schematic plots for an adjustable additive delivery timing sequence for one embodiment described herein. FIG. 5A demonstrates the remaining thickness of the material layer on the y-axis verses time (seconds) on the x-axis. FIG. 5B demonstrates the additive flow rate on the y-axis verses the time (seconds) on the x-axis. For example, the additive used in FIG. 5B during the initial stages, for example, the bulk polishing step of the CMP process shown in FIG. 5A, may comprise a rate promoter to increase the polishing rate of the material layer. The additive used in FIG. 5C during the final stages, for example, the residual polishing step of the CMP process shown in FIG. 5A may comprise a corrosion reducing additive to reduce dishing and other defects commonly occurring during the final stages of a CMP process. In one embodiment, the polishing additive may be selectively distributed to specific regions of the substrate using the adjustable additive delivery nozzle 224 during specific stages of the polishing process. In one embodiment, selective distribution of polishing additives may occur in response to monitoring of the substrate polishing profile 110. In one embodiment, the selective distribution of polishing additives during specific stages of the polishing process may be used in conjunction with the RTPC model of the substrate 110.

The timing sequence for additive delivery, the additive delivery points, and additive flow paths may be determined by polishing a set-up substrate or series of set-up substrates with similar profiles using similar polishing conditions. The timing sequence, the additive delivery points, and additive flow paths may be determined using a series of algorithms which take into account such processing parameters as platen rotation rate, substrate rotation rate, the components of the polishing slurry, the flow rate of the polishing slurry, the flow rate of the additives, and combinations thereof. The timing sequence, the additive delivery points and additive delivery flow paths determined by polishing the set-up substrates may be stored in a library in controller 190.

While the foregoing is directed to embodiments of the present invention, other and further embodiments of the invention may be devised without departing from the basic scope thereof, and the scope thereof is determined by the claims that follow.

The invention claimed is:

1. A method of processing a semiconductor substrate, comprising:

positioning a substrate on a polishing apparatus comprising a polishing pad assembly;

delivering a polishing slurry to a surface of the polishing pad assembly;

polishing the substrate with the surface of the polishing pad assembly;

monitoring a removal rate of material from a plurality of regions on the surface of the substrate;

determining whether the plurality of regions on the surface of the substrate are polishing uniformly; and selectively delivering a polishing slurry additive to at least one region of the plurality of regions to obtain a uniform removal rate of material from the plurality of regions on the surface of the substrate, wherein the removal rate of material for the at least one region is different than at least one other region of the plurality of regions.

2. The method of claim 1, wherein selectively delivering a polishing slurry additive to at least one region of the plurality of regions comprises adjusting an adjustable slurry delivery nozzle to deliver the polishing slurry additives to the surface of the polishing pad assembly.

3. The method of claim 2, wherein selectively delivering a polishing slurry additive to at least one region of the plurality of regions further comprises selecting an additive delivery flow path to deliver the additive to the at least one region of the plurality of regions.

4. The method of claim 3, wherein the additive delivery flow path is determined by using a series of algorithms which take into account processing parameters selected from platen rotation rate, substrate rotation rate, components of the polishing slurry, flow rate of the polishing slurry, flow rate of the additives, and combinations thereof.

5. The method of claim 1, wherein the polishing slurry additive is selected from the group comprising corrosion inhibitors, polymeric inhibitors, surfactants, rate promoters, abrasives, and combinations thereof.

6. The method of claim 1, wherein the monitoring a removal rate of material from a plurality of regions on the surface of the substrate comprises developing a real-time profile control model of the surface of the substrate.

7. The method of claim 6, wherein selectively delivering a polishing slurry additive to at least one region of the plurality of regions comprises adjusting an adjustable slurry delivery nozzle to deliver additives to the at least one region of the plurality of regions.

8. The method of claim 7, wherein the at least one region of the plurality of regions is polishing at a faster rate than the at least one other region of the plurality of regions and the polishing slurry additive comprises a corrosion inhibitor.

9. The method of claim 7, wherein the at least one region of the plurality of regions is polishing at a slower rate than the at least one other region of the plurality of regions and the polishing slurry additive comprises a rate promoter.

10. The method of claim 1, wherein selectively delivering a polishing slurry additive to at least one region of the plurality of regions to obtain a uniform removal rate of material occurs while polishing the substrate with the surface of the polishing pad assembly.

11. A method of processing a semiconductor substrate, comprising:

positioning a substrate on a polishing apparatus comprising a polishing pad assembly and a polishing fluid dispense arm assembly comprising an adjustable additive delivery nozzle;

determining an incoming thickness profile of a conductive material across a surface of the substrate;

polishing the substrate with a surface of a polishing pad assembly;

developing a real-time thickness profile model of the conductive material across the surface of the substrate; and positioning the adjustable additive delivery nozzle and selectively delivering a polishing slurry additive to the surface of the substrate to obtain a uniform removal rate of material from the plurality of regions on the surface of the substrate.

12. The method of claim 11, wherein the developing a real-time thickness profile model of the conductive material comprises monitoring the thickness of the conductive material at different regions on the surface of the substrate.

13. The method of claim 11, wherein the polishing slurry additive is selected from the group comprising corrosion inhibitors, polymeric inhibitors, surfactants, rate promoters, abrasives, and combinations thereof.

14. The method of claim 11, positioning the adjustable additive delivery nozzle and selectively delivering a polishing slurry additive to the surface of the substrate to obtain a uniform removal rate of material from the plurality of regions on the surface of the substrate occurs while polishing the substrate with a surface of a polishing pad assembly.

* * * * *